United States Patent [19]

Infeld

[11] Patent Number: 4,835,860

[45] Date of Patent: Jun. 6, 1989

[54] CARTON-OPENING TOOL

[76] Inventor: Andrew L. Infeld, 9220 SW. 146th St., Miami, Fla. 33176

[21] Appl. No.: 245,213

[22] Filed: Sep. 16, 1988

Related U.S. Application Data

[63] Continuation-in-part of Ser. No. 60,061, Jun. 9, 1987.

[51] Int. Cl.[4] ..... B67R 7/00

[52] U.S. Cl. ..... 30/2; 30/123; 30/142; 30/450; 7/151

[58] Field of Search ..... 30/1, 2, 142, 324, 407, 30/410, 413, 414, 429–431, 443, 450; 7/151, 156

[56] References Cited

U.S. PATENT DOCUMENTS

| | | | |
|---|---|---|---|
| 1,001,060 | 8/1911 | McPeak | 30/410 |
| 2,609,715 | 9/1952 | Eades | 30/2 X |
| 2,770,877 | 11/1956 | Bird | 30/123 |
| 4,398,314 | 8/1983 | Converse et al. | 7/151 |

FOREIGN PATENT DOCUMENTS

| | | | |
|---|---|---|---|
| 556853 | 2/1960 | Belgium | 30/450 |
| 734121 | 7/1955 | United Kingdom | 30/450 |

*Primary Examiner*—Frank T. Yost
*Assistant Examiner*—Michael D. Folkerts
*Attorney, Agent, or Firm*—Oltman and Flynn

[57] ABSTRACT

A hand tool for opening a paperboard carton having a push-in tab at a top corner. The tool has a generally spoon-shaped body with a bowl at one end of a handle and a bent arm extending from the handle in the same direction as the bowl and terminating in a free end more than half-way along the bowl toward its pointed distal end. The tool may be held upright, with the free end of its bent arm engaging the top of the carton and the distal end of its bowl engaging the pushed-in tab, and then rocked to push in the tab. A projection on the inside of the bowl near its distal end is engageable with the push-in tab to pull it out when the tool is pulled away from the carton. The bowl has inclined opposite edges with teeth between its distal end and the free end of the arm for engaging the push-in tab.

16 Claims, 2 Drawing Sheets

FIG. 9
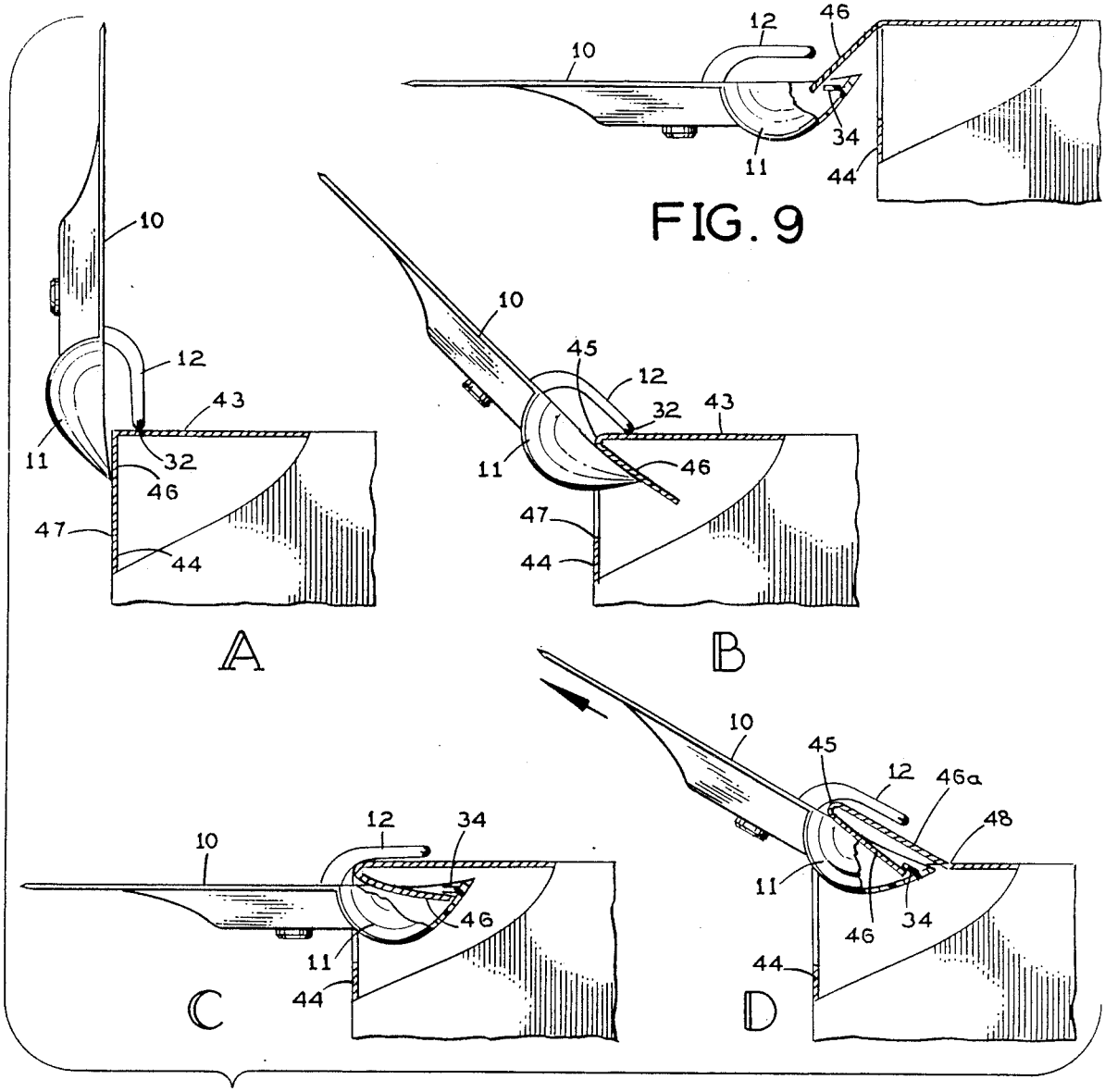
FIG. 8
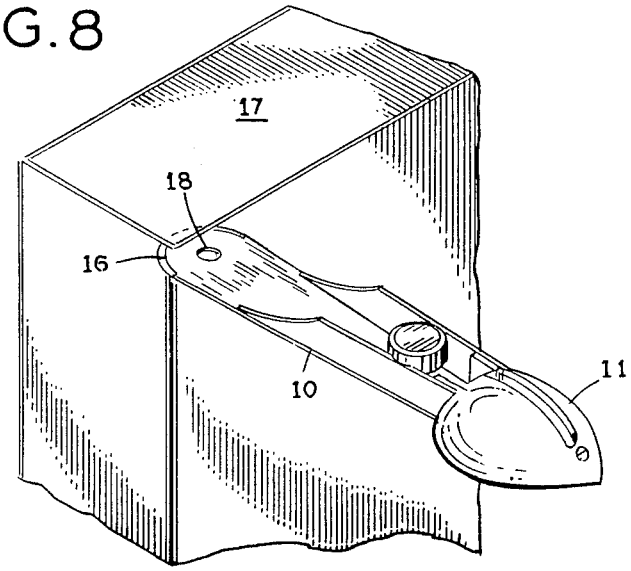
FIG. 10

CARTON-OPENING TOOL

CROSS-REFERENCE TO RELATED APPLICATION

This application is a continuation-in-part of my co-pending U.S. patent application Ser. No. 07/060,061, filed June 9, 1987, pending.

SUMMARY OF THE INVENTION

This invention relates to a hand tool for opening various paperboard cartons, particularly those having a push-in tab at a top corner.

Many paperboard cartons, such as those containing laundry detergents or food products, have a push-in tab at a top corner which in actuality is not easily opened manually. The present invention is directed to a hand-held tool which solves this problem.

It is, therefore, a principal object of this invention to provide a novel hand tool for opening the push-in tab of a paperboard carton.

Briefly, the present invention comprises a spoon-shaped body having a handle and a generally ovoid bowl on one end of the handle. A rigid arm, joined to the handle at the end where the bowl is located, projects from the handle generally parallel to the bowl and on the opposite side of the handle from the bowl. This arm terminates in a free end located more than half-way along the length of the bowl from its attachment to the handle.

When used with a carton having a push-in tab extending down from one top corner, the tool is held with the handle extending up from the bowl, the free end of the arm engaging the top of the carton, and the distal end of the bowl (away from the handle) engaging the push-in tab of the carton. By rocking the tool in a direction to push the bowl in against the tab while holding the free end of the arm against the top of the carton, the carton tab is pushed in fairly easily.

Near its distal end the bowl has a projection on the inside which engages over the bottom edge of the pushed-in tab on the carton and causes the pushed-in tab to be pulled out beyond the adjoining side of the carton when the tool is withdrawn, thereby facilitating the pouring of the contents of the container through the opening formed in the carton at the location of the tab.

Preferably, the distal half of the bowl has teeth which will break open the tab if it does not separate from the side of the carton along the usual score lines defining the tab.

Further objects and advantages of this invention will be apparent from the following detailed description of a presently preferred embodiment which is illustrated schematically in the accompanying drawings.

DESCRIPTION OF THE DRAWINGS

FIG. 8 is a composite view showing successive stages A, B, C and D in the opening of the push-in tab of a carton using the tool of FIGS. 1–6, with the carton shown in section at the top corner where the push-in tab is located and with the top of the carton being bent up after the tab is pushed in;

FIG. 9 is a view similar to FIG. 8 and showing the final stage of opening a pushed-in tab without bending up the top of the carton; and FIG. 10 shows another way of using the present tool to open the top of a different type of carton.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 2:
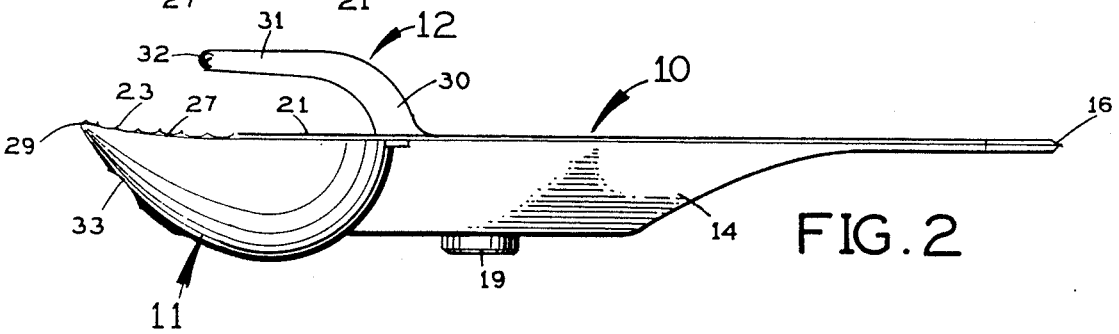
FIG. 2 is a side elevation.

Referring to FIG. 2, the present carton-opening tool has an elongated substantially straight handle 10, a bowl 11 joined to the handle at one end, and a rigid bent arm 12 joined to the handle at that same end and extending generally parallel to the bowl 11 on the opposite side of the handle 10 from the bowl. The handle 10 and bowl 11 together form a generally spoon-shaped body. In the position shown in FIG. 2, the handle 10 extends horizontally and the rounded wall of bowl 11 extends down from the handle. For convenience of description, the various parts of the tool will be described as they appear in this position.

Figure 5:
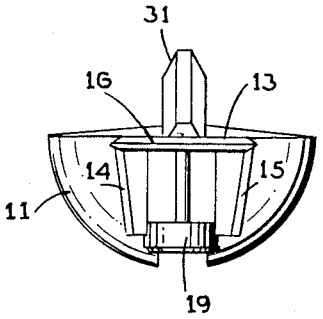
FIG. 5 is an end elevation taken from the right end of FIG. 2.

The handle 10 has a substantially flat top wall 13 and opposite sides 14 and 15 (FIG. 5) extending down from this top wall for much of its length. At its end away from the bowl 11, the handle presents a substantially semicircular edge 16 which is beveled on the top and the bottom and comes to a sharp point that facilitates its slidable insertion beneath the top panel 17 of a paperboard carton, as shown in FIG. 9. Near this end the handle has an opening 18 for receiving a wall-mounted hook (not shown) from which the tool may hang down when not is use. On the bottom the handle carries a permanent magnet 19 of known design which is press-fitted between its sides 14 and 15 and projects slightly below these sides for contact with a ferromagnetic support (not shown), such as the front of a refrigerator door.

Figure 1:
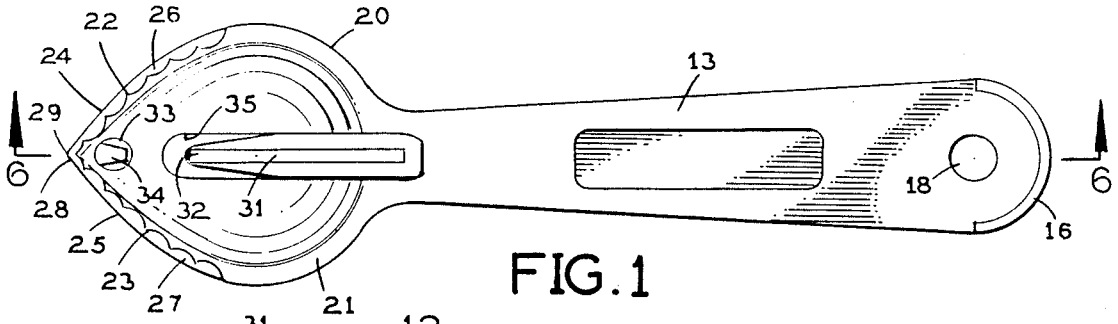
FIG. 1 is a top plan view of the present tool.
Figure 4:
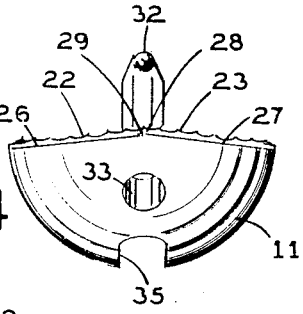
FIG. 4 is an end elevation from the left end of FIG. 2.
Figure 6:
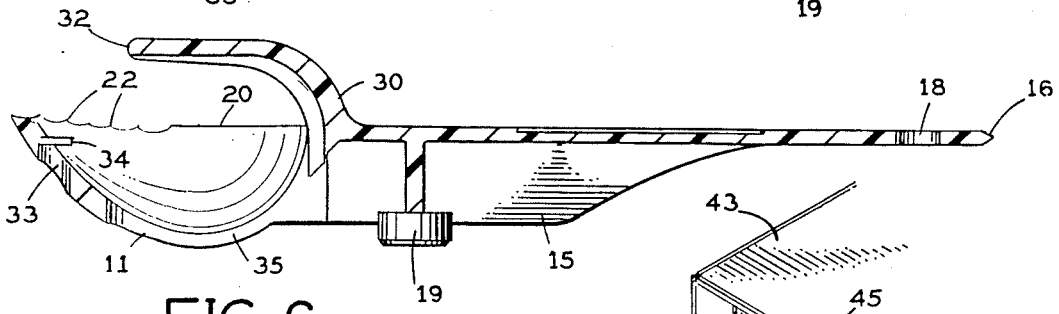
FIG. 6 is a longitudinal section taken along the line 6—6 in FIG. 1.

The bowl 11 is molded integral with handle 10 at the opposite end of the handle from its curved, beveled edge 16 and it is a longitudinal extension of the handle. The bowl is generally ovoid. At its juncture with the handle and for about half its length away from the handle, the bowl presents rounded opposite top edges 20 and 21 (FIGS. 1, 2 and 6) which curve out from the handle on opposite sides and are co-planar with the top surface of the handle's top wall 13. For the remaining distal half of the bowl, its opposite top edges incline upward at a very small angle to the top surface of the handle's top wall, as best seen in FIGS. 4 and 6. Here the bowl presents a series of sharp-pointed teeth 22 and 23 (FIGS. 1, 2, 4 and 6) which, as best seen in FIG. 1, are located a short distance laterally inward from the bowl's outer top edges 24 and 25. Inward from these top edges 24 and 25 to the teeth 22 and 23, the opposite sides of the bowl present substantially flat top faces 26 and 27 (FIGS. 1, 2 and 4) which intersect the teeth at their lower ends. At the distal end of the bowl 11 remote from the handle 10, the teeth 22 and 23 on its opposite sides come together at an end tooth 28, which presents a sharp edge at the longitudinal centerline of the bowl and the handle, and the top faces 26 and 27 intersect at a slightly rounded end corner 29.

The curved arm 12 has a lower segment 30 (FIG. 2) which is joined to the top wall 13 of the handle at the end of the handle where the bowl 11 is attached. This lower segment 30 of the arm curves up and away from the handle through a 90 degree rounded bend and the arm continues parallel to the general direction of the bowl 11 away from handle 10, as a straight horizontal longitudinal segment 31 which extends above the bowl along its longitudinal centerline to a rounded tip 32, which is located slightly more than half-way along the length of the bowl. In one practical embodiment the longitudinal segment 31 of arm 12 is about one-half inch above the level of the top edges 20 and 21 of bowl 11 when the tool is horizontal, as shown in FIG. 2.

Figure 3:
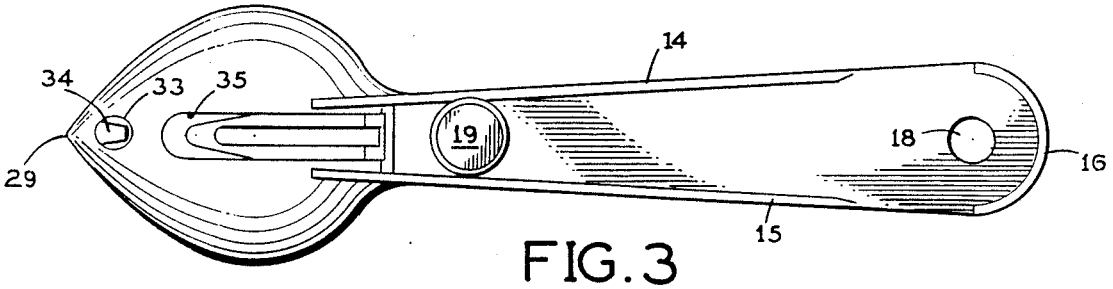
FIG. 3 is a bottom plan view.

The distal half of the bowl 11 is substantially triangular, as shown from above in FIG. 1 and from below in FIG. 3. A short distance from its distal end tip at 29, the bowl is formed with an opening 33 of oblong cross-section. At the top of this opening a short, flat, horizontal projection 34 (FIG. 6) extends at the inside of the bowl toward the handle past the inside surface of the bowl on either side of this projection.

The bowl also is formed with an elongated slot 35 on the bottom which has no functional purpose in the tool's operation but relates to the molding technique used in manufacturing the tool.

Figure 7:
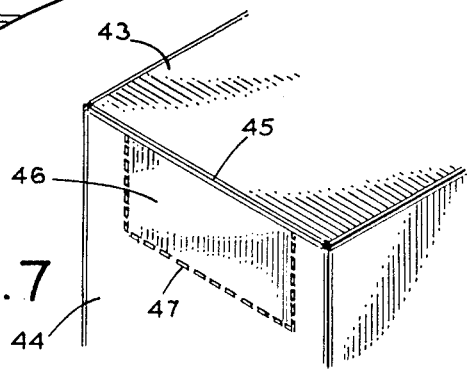
FIG. 7 is a fragmentary perspective view showing the top corner of a paperboard carton having a push-in tab.

FIG. 7 shows the top corner of a paperboard carton of known design, having a flat top panel 43, a flat side panel 44 extending down from the top panel and forming a right-angled corner 45 with it, and a push-in tab 46 in this side panel extending down from the corner 45. This tab is defined by a channel-shaped line 47 of perforations or indentations in the side panel where the tab 46, when pushed in, is supposed to separate from the rest of the side panel.

FIG. 8 shows the successive phases of the operation of the present tool when used with a carton as shown in FIG. 7 to push in the tab 46 and assuming that the tab separates from the side of the carton along the score line 47.

Initially, as shown at A in FIG. 8, the tool is positioned with the free end 32 of its arm 12 engaging the top panel 43 of the carton, the end tooth 28 and the rounded corner 29 on the distal end of its bowl 11 against the tab 46, and the handle 10 extending vertically up from the bowl.

At B in FIG. 8, the handle 10 has been rocked about 45 degrees clockwise while the user has held the free end of arm 12 down against the carton's top panel. The distal end tip of the bowl 11 pushes in the tab 46, causing it to separate from the remainder of the side panel 44 along the score line 47.

At C in FIG. 8, continued movement of the handle through another 45 degrees in the same direction has caused the top edges of the bowl 11 to fold the flap 46 in and up toward the top panel 43 next to the corner 45 of the carton. The projection 34 on the inside of the bowl 11 has moved up past the bottom edge 46' of the pushed-in tab 46, so this projection extends over the free end of the pushed-in tab.

Finally, as shown at D in FIG. 8, the handle 11 is raised counterclockwise enough to bend the top panel 43 of the carton along a bend line at 48, thereby enlarging the opening at the top corner of the carton. When the tool is pulled away from the carton (as indicated by the arrow) projection 34 on the inside of the bowl 11 pulls the pushed-in tab 46 of the carton out from beneath the carton top 43 to a position in front of the side panel 44 of the carton. Therefore, the tab does not impede the pouring out of the carton's contents.

FIG. 9 shows the final stage in the tool's operation on a carton without bending up the top panel of the carton as in stage D of FIG. 8. As the tool is withdrawn after pushing in the push-in tab 46, the projection 34 on the inside of the bowl 11 of the tube engages the pushed-in tab near its bottom edge 46' and pulls the tab out past the side panel 44 of the carton.

In some cases the push-in tab 46 does not separate from the side panel 44 along the score line 47. In that case the teeth 22 on the top edge the distal half of the bowl 11 of the tool will dig into the material of the tab and break it open substantially along lines defined by this edge of the bowl. This severing action begins at the distal end tip of the bowl and continues progressively along its opposite sides toward the handle 10 because of the downward inclination of the top edge of the bowl away from its distal end tip. The distal end tooth 28 engages the tab 46 first, followed in succession by the other teeth 22 as the tool is rocked clockwise in FIG. 8. This makes it relatively easy to open a carton having a push-in tab which puts up excessive resistance to being broken open along the score line which defines it, usually because of a manufacturing defect in the carton.

As already mentioned, FIG. 10 shows how the present tool may be used to open another type of carton by inserting the bevel-edged convex end 16 of its handle 10 beneath the top flap 17 of the carton.

I claim:

1. A hand tool for opening a paperboard carton which has a top panel and a side panel extending down from said top panel and forms a substantially 90 degree top corner of the carton therewith, said side panel having a push-in tab extending down from said corner and defined by lines of weakened material of said side panel, said tool comprising:

a generally spoon-shaped body having a generally ovoid bowl and a handle joined to and extending from one end of said bowl;

said body, when in a position with its handle substantially horizontal and its bowl open at the top, presenting a well-defined corner on the top at the distal end of the bowl away from the handle;

and a rigid arm which, in said position of said body, extends up from said handle at said one end of the bowl and continues through a substantially 90 degree bend and extends centrally over said bowl for at least substantially half the length of the bowl from said handle to said distal end, said arm terminating in a free end spaced above the top of said bowl.

2. A tool according to claim 1 wherein said bowl, in said position of said body, presents opposite top edges between its distal end and said free end of said arm which have upwardly projecting teeth.

3. A tool according to claim 1 wherein:

said bowl, in said position of said body, presents an upwardly projecting pointed tooth on the top at its distal end;

and said top edges of the bowl are inclined downward away from its distal end.

4. A tool according to claim 3 wherein said bowl, in said position of said body, has a short projection on the inside spaced below its top edge near its distal end and extending toward said handle, said projection being engageable with said tab on the carton after it has been pushed in from said side panel.

5. A tool according to claim 4 wherein said bowl, in said position of said body, presents opposite top edges between its distal end and said free end of said arm which have upwardly projecting teeth.

6. A tool according to claim 3 wherein said bowl, in said position of said body, presents opposite top edges between its distal end and said free end of said arm which have upwardly projecting teeth.

7. A tool according to claim 1 wherein said bowl, in said position of said body, has a short projection on the inside spaced below its top edge near its distal end and extending toward said handle, said projection being engageable with said tab on the carton after it has been pushed in from said side panel.

8. A tool according to claim 2 wherein said bowl, in said position of said body, has a short projection on the inside spaced below its top edge near its distal end and extending toward said handle, said projection being engageable with said tab on the carton after it has been pushed in from said side panel.

9. A hand tool for opening a paperboard carton which has a top panel and a side panel extending down from said top panel and forms a substantially 90 degree top corner of the carton therewith, said side panel having a push-in tab extending down from said corner and defined by lines of weakened material of said side panel, said tool comprising:

a generally spoon-shaped body having a generally ovoid bowl and a handle joined to and extending from one end of said bowl;

said body, when in a position with its handle substantially horizontal and its bowl open at the top, presenting a well-defined corner on the top at the distal end of the bowl away from the handle;

a rigid arm which, in said position of said body, extends up from said handle at said one end of the bowl and continues through a substantially 90 degree bend and extends centrally over said bowl and terminates in a free end spaced above the top of said bowl;

and a short projection on the inside of said bowl spaced below the top of said bowl near its distal end and extending toward said handle, said projection being engageable with said tab on the carton after it has been pushed in from said side panel.

10. A tool according to claim 9 wherein said bowl, in said position of said body, presents an upwardly projecting tooth on the top at its distal end and opposite top edges which are inclined downward away from its distal end.

11. A tool according to claim 10 wherein said bowl has upwardly projecting teeth on said opposite top edges between its distal end and said free end of said arm.

12. A tool according to claim 9 wherein said bowl has upwardly projecting teeth on said opposite top edges between its distal end and said free end of said arm.

13. A tool according to claim 9 wherein said arm extends at least substantially half the length of the bowl from said handle to said distal end of the bowl.

14. A tool according to claim 10 wherein said arm extends at least substantially half the length of the bowl from said handle to said distal end of the bowl.

15. A tool according to claim 11 wherein said arm extends at least substantially half the length of the bowl from said handle to said distal end of the bowl.

16. A tool according to claim 12 wherein said arm extends at least substantially half the length of the bowl from said handle to said distal end of the bowl.

* * * * *